US006467230B1

(12) United States Patent
Perkins et al.

(10) Patent No.: US 6,467,230 B1
(45) Date of Patent: Oct. 22, 2002

(54) INTERCONNECTION DEVICE AND METHOD FOR SECURING A SAFETY RAIL

(75) Inventors: Simon Perkins, West Falls; Peter Ralyea, Orchard Park, both of NY (US)

(73) Assignee: Kee Klamp Limited, Reading (GB)

( * ) Notice: Subject to any disclaimer, the term of this patent is extended or adjusted under 35 U.S.C. 154(b) by 0 days.

(21) Appl. No.: 09/722,265

(22) Filed: Nov. 28, 2000

(51) Int. Cl.[7] ..... E04H 17/14; E04B 7/18

(52) U.S. Cl. ..... 52/655.1; 52/20; 52/653.2; 52/656.9; 256/65.14; 256/DIG. 6; 248/220.1

(58) Field of Search ..... 52/656.9, 653.1, 52/653.2, 655.1, 657, 658, 19, 20, DIG. 12; 256/DIG. 6, 65, 65.14, 65.16; 182/106, 112, 113; 248/237, 220.1

(56) References Cited

U.S. PATENT DOCUMENTS 4,338,040 A * 7/1982 Hawkins ..... 182/113 X
4,577,449 A * 3/1986 Celli ..... 52/655.1 X
5,492,429 A * 2/1996 Hodges ..... 52/165 X
5,586,423 A * 12/1996 Mullen ..... 52/653.2
6,167,659 B1 * 1/2001 Swindell, III ..... 52/20
6,272,800 B1 * 8/2001 Phinney et al. .... 52/DIG. 12 X
6,279,880 B1 * 8/2001 Hawks, Jr. ..... 256/65.14 X

FOREIGN PATENT DOCUMENTS

FR 2559192 * 8/1985 ..... 256/65
GB 885156 * 12/1961 ..... 256/65

* cited by examiner

*Primary Examiner*—Laura A. Callo
(74) *Attorney, Agent, or Firm*—Young & Thompson

(57) ABSTRACT

A structural interconnection device for attachment of an elongate member to a rigid frame includes at least one flange portion adapted for attachment to the rigid frame and a receiving portion. The receiving portion includes a locking mechanism for selectively releasably securing thereto an end portion of an elongate member. The flange portion has a location surface for bearing against the rigid frame. The location surface lies, in use, in a plane which is substantially parallel with a longitudinal axis of an end portion of an elongate member secured to the receiving portion. The plane of the location surface lies, in use, in a plane displaced from the longitudinal axis of the end portion of the elongate member.

15 Claims, 4 Drawing Sheets

SECTION X - X

SECTION X - X

INTERCONNECTION DEVICE AND METHOD FOR SECURING A SAFETY RAIL

BACKGROUND OF THE INVENTION

This invention relates to an interconnection device and method for securing a safety rail, and in particular, but not exclusively, to an interconnection device and a method for securing a safety rail to the frame of an access hatch such as a roof hatch.

In order to comply with safety regulations it is known to secure a safety rail structure to a rigid frame which defines a roof hatch opening such as is commonly provided in a flat roof. In one known and established technique of constructing a safety rail structure, vertical posts for forming part of a safety rail assembly are welded to brackets that in turn are bolted to the hatch frame. In general on site welding of the posts to the brackets is not convenient and, in the case of brackets pre secured to a roof hatch, on site welding creates an unacceptable risk of damage to the roofing material surrounding the hatch. It is therefore common practice to pre-weld the posts and brackets to one another, but that results in sub-assemblies of an inconvenient shape for storage and transportation.

SUMMARY OF THE INVENTION

One object of the present invention is to provide an improved interconnection device and method for securing a post of a safety rail assembly to a hatch structure.

In accordance with one aspect of the present invention a method of securing a safety rail structure to a hatch structure comprises providing an interconnection device comprising at least one flange portion adapted for attachment to a rigid frame of the hatch structure and a receiving portion for receiving a part of the safety rail structure, said receiving portion comprising locking means for selectively releasably securing thereto an end portion of an elongate member of the safety rail structure.

The method may comprise securing at least one said structural interconnection device to the frame of a hatch either prior to or subsequent to fitting the hatch frame to an opening in a roof or other surface and then securing to the or each structural interconnection device an end portion of an elongate member which forms a part of the safety rail structure. Preferably the end portion of an elongate member is selectively releasably secured to a structural interconnection device. The structural interconnection device may be provided with locking means operable to engage with the end portion of the elongate member and thereby secure that member to the interconnection device and hatch frame.

The method of the invention may comprise use of a structural interconnection device of a type as hereinafter more specifically disclosed.

In accordance with a further aspect of the present invention a structural interconnection device for attachment of an elongate member to a rigid frame comprises at least one flange portion adapted for attachment to the rigid frame, and a receiving portion comprising locking means for selectively releasably securing thereto an end portion of an elongate member, said flange portion having a location surface for bearing against said rigid frame and said location face lying, in use, in a plane which is substantially parallel with a longitudinal axis of an end portion of the elongate member secured to said receiving portion and said plane of the location face lying, in use, in a plane displaced from said longitudinal axis of the end portion of the elongate member.

Preferably the flange and receiving portions are integrally formed. They may, for example, be integrally formed from cast iron, steel or aluminium.

The receiving portion may comprise a tubular shaped formation into which the end portion of an elongate member may be received. Said receiving portion may comprise a bore of circular or, for example, square cross-section. The bore may be of uniform dimension along its length, or it may be formed with axially spaced ribs that extend inwards and provide bearing surface regions for contact by the end portion of the elongate member.

The locking means may, for example, comprise at least one screw threaded aperture formed in a wall portion of the receiving portion and into which a grub screw or like member may be received and rotated to bear at an inner end against the surface of an end portion of an elongate member. If the bore of the receiving portion comprises at least one pair of axially spaced ribs, preferably a screw threaded aperture is provided at an axial position between the or each successive pair of ribs. One end of the bore may comprise an inwardly extending projection to act as a limit stop abutment against which an end of an elongate member may abut. Said abutment formation may be provided with a central aperture thereby to allow for drainage. Preferably that end of the receiving portion formed with an abutment is aligned with any edge (in use a lower edge) of the or each flange portion. The other end of the receiving portion may extend beyond the other, in use upper, edge of the or each flange portion.

The interconnection device may comprise a single flange portion and location surface for bearing against a rigid frame. In that case preferably a screw threaded aperture or like locking means of the receiving portion lies at a region of the receiving portion furthest from said location surface.

The interconnection device may comprise two flange portions the respective location surfaces of which lie in planes perpendicular to one another and each displaced from but parallel with a longitudinal axis of a bore defined by the receiving portion. A screw threaded aperture or like locking means of the receiving portion may lie in a plane which contains the longitudinal axis of a bore of the receiving portion and which intersects the angle defined between two location surfaces. In the case of an interconnection device comprising two flange portions, the location surface of each flange portion may be spaced from the receiving portion by an intermediate section. Preferably said intermediate sections of the two associated with the two flange portions are spaced apart thereby to provide a space which, in use, may be occupied by roofing material e.g. where roofing material of sheet form has been folded in the vicinity of a corner of a hatch frame.

The present invention further provides a safety rail system for an access hatch and comprising as discreet and interconnectable components elongate post members for extending vertically in use, elongate rail members for extending substantially horizontally in use, connectors for interconnecting the posts and rails, and structural interconnection devices to which ends of the posts may be secured, said interconnection devices being of a kind in accordance with the present invention and each comprising at least one flange surface for securing to the frame of a hatch structure.

Embodiments of the present invention will now be described, by way of example only, with reference to the accompanying diagrammatic drawings in which:

DETAILED DESCRIPTION OF THE PREFERRED EMBODIMENTS

Figure 4:
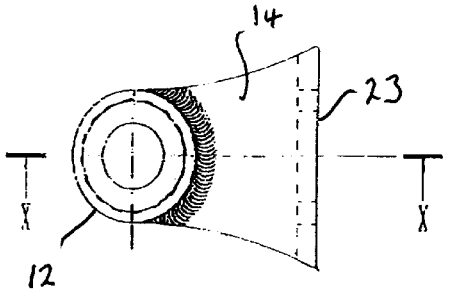
FIG. 4 is a view in the direction of arrow "y" of FIG. 1.
Figure 2:
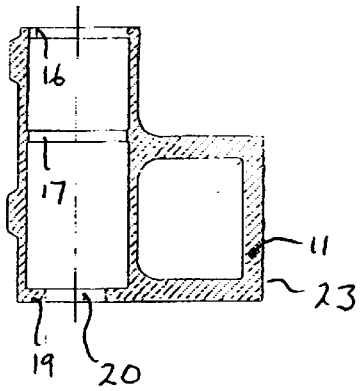
FIG. 2 is a sectional view of the device shown in FIG. 1 on the line 'X'—'X' of FIG. 4.
Figure 1:
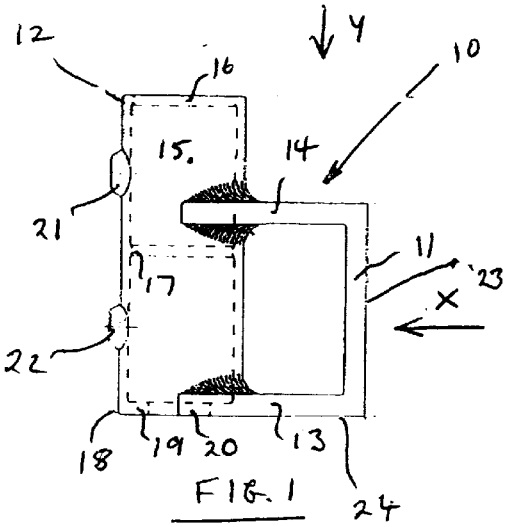
FIG. 1 is a side view of an interconnection device in accordance with one embodiment of the present invention.
Figure 3:
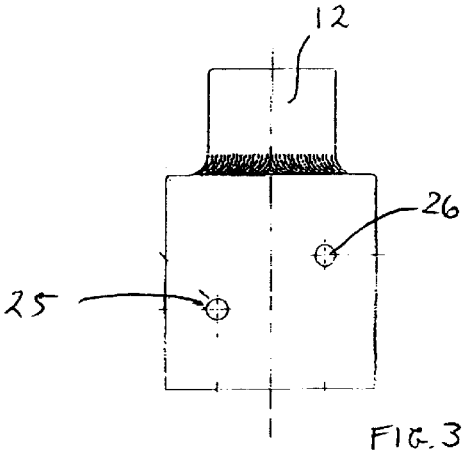
FIG. 3 is a view in the direction of the arrow "x" of FIG. 1.
Figure 8:
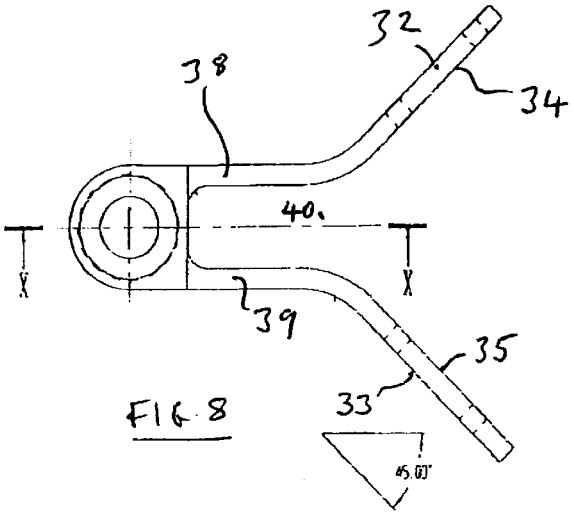
FIG. 8 is a view in the direction of arrow "y" of FIG. 5.
Figure 6:
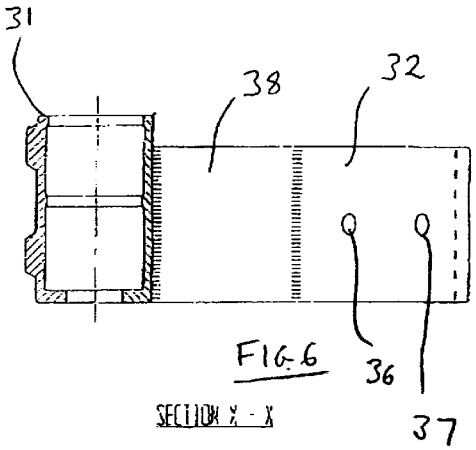
FIG. 6 is a sectional view corresponding to FIG. 5, taken on the line 'X'—'X' of FIG. 8.
Figure 5:
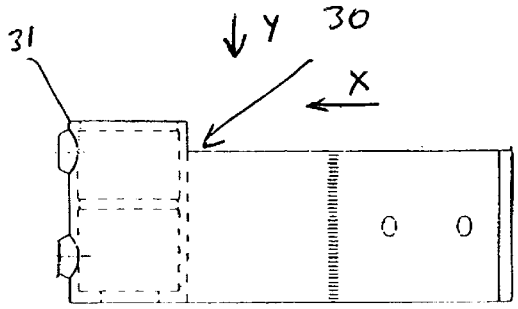
FIG. 5 is a side view of an interconnection device in accordance with a second embodiment of the present invention.
Figure 7:
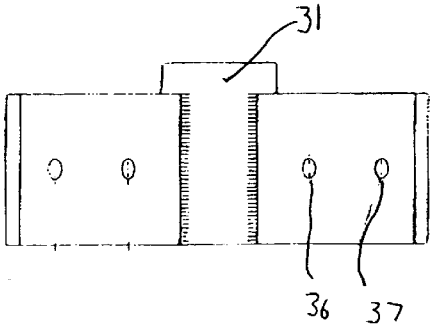
FIG. 7 is a view in the direction of arrow "x" of FIG. 5.
Figure 9:
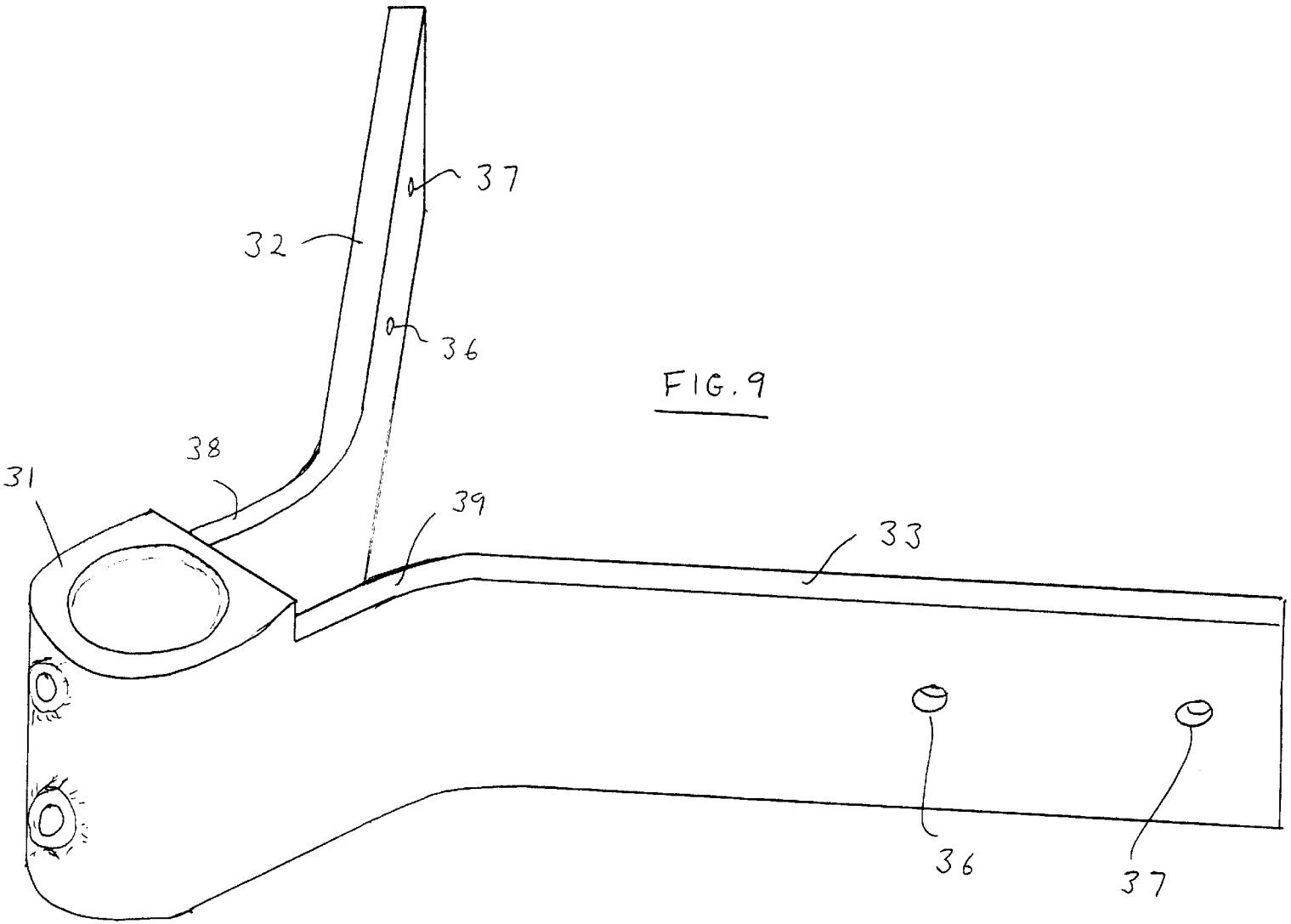
FIG. 9 is a perspective view of the device of FIGS. 5 to 8.

A structural interconnection device in the form of a connector (10) of cast iron comprises a flange portion (11) which defines a location face (23) and a receiving portion (12) secured to the flange portion (11) by two spacing portions (13, 14).

The receiving portion (12) is of a substantially tubular form and comprises a circular section bore (15) provided with two inwardly directed ribs (16, 17) lying respectively at an upper end and mid-length position. At the lower end (18) the receiving portion (12) is formed with a radially inwardly extending abutment flange (19) which defines a central bore (20). Substantially midway between the ribs (16,17) the receiving portion is formed with a first screw threaded opening (21). A second screw threaded opening (22) is provided between the central rib (17) and the lower abutment flange (19). The screw threaded openings (21, 22) are positioned at a region of the receiving portion (12) which is furthest from the location face (23).

The lower edge (24) of the location face (23) is aligned with the end (18) of the receiving portion as considered relative to a longitudinal axis defined by the bore (15) of the receiving portion.

The location flange portion (11) is provided with two apertures (25, 26).

In use of the connector (10) to secure a vertical post to a roof hatch frame, the connector is first secured to the frame by means of bolts which extend through the holes (25, 26). The connector is orientated with the lower edge (24) lying lowermost. A vertical post is then inserted into the bore (15), with the lower end resting upon the lower flange (19). Grub screws are then tightened in the screw threaded apertures (21, 22) to hold the lower end of the post firmly against the location ribs (16, 17) of the receiving portion (12).

In a second embodiment of the invention illustrated with reference to FIGS. 5 to 9, a connector (30) comprises a receiving portion (31) which corresponds substantially with the receiving portion (12) of the connector (10) of the first embodiment. In the second embodiment the connector (30) is provided with two flange portions (32, 33) which respectively define location faces (34, 35) that lie in planes perpendicular to one another and each displaced from but parallel with the longitudinal axis of the bore defined by the receiving portion (31). Each flange portion (32, 33) is provided with a pair of location apertures (36, 37) whereby each flange portion may be secured to a respective side edge of a hatch frame.

The two flange portions (32, 33) are connected integrally with the receiving portion by respective intermediate portions (38, 39) that extend substantially parallel with one another and define therebetween a void (40). The void (40) allows, in use, small increases in surface level of a roof structure adjacent to corners of a hatch frame to be accommodated without the connectors needing to be secured at a higher position on the side of the hatch frame.

In each of the first and second embodiments the flange portions have, in use, a vertical height which is slightly less than that of the axial length of the receiving portion. The receiving portion can be made of greater length relative to the height of the or each flange potion thereby to provide stable location for the lower end of a guard rail post whilst the flange portions can be limited to a height which does not need to exceed the height of a hatch frame.

Figure 10:
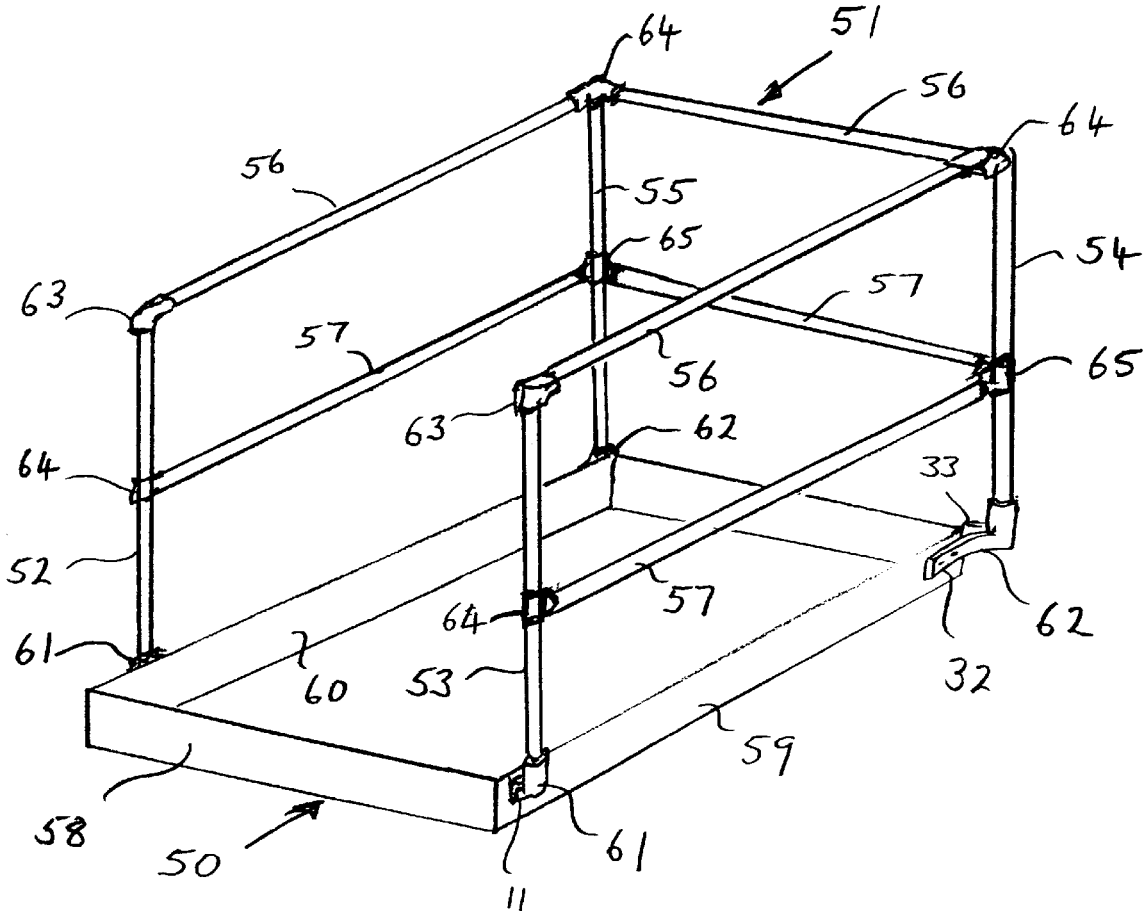
FIG. 10 is a perspective view of a safety rail system of the present invention secured to an access hatch.

FIG. 10 shows a rectangular metal hatch access frame (50) secured or securable to a roof structure (not shown) and having secured thereto a safety rail system (51) in accordance with the present invention.

The safety rail system comprises four vertical posts (52,53,54,55) which support, at three sides of the hatch rectangle, horizontal safety rails (56,57).

Two of the posts (52,53) neighbour an open side (58) of the frame and are each secured to a frame side (59,60) by a post interconnection device (61) which is of the type shown in FIGS. 1 to 4 and comprises a single flange (11). Bolts extend through the flange (11) to secure it to the frame (50).

The other two posts (54,55) are each mounted close to the other corners of the frame (50) by a post interconnection device (62) which is of the type shown in FIGS. 5 to 9 and comprises two flange potions (32,33). Bolts extend through the two flanges of each device (62) to secure it to the adjacent end regions of two sides of the frame (50).

The vertical posts provide support for three horizontal top guard rails (56) and three intermediate guard rails (57). The posts and rails are secured together by two, three and four way connectors (63,64,65) of types known per se.

The posts (51,52,53,54), rails (56,57), interconnection devices (61,62) and the connectors (63,64,65) may comprise individual components of a kit. They may be (optionally selectively releasably) securable together to construct the assembly as shown in FIG. 10.

What is claimed is:

1. A structural interconnection device for attachment of an elongate member to a rigid frame of an access hatch, said interconnection device comprising:

two flange portions each adapted for attachment to the rigid frame, and a receiving portion comprising locking means for selectively releasably securing thereto an end portion of an elongate member, each said flange portion having a location surface for bearing against said rigid frame and said location surface lying, in use, in a plane which is substantially parallel with a longitudinal axis of an end portion of an elongate member secured to said receiving portion, said plane of the location surface of one of said two flange portions lying, in use, in a plane displaced from said longitudinal axis of an end portion of the elongate member and extending substantially perpendicular relative to a plane of the location surface of an other of said two flange portions, each of the two flange portions having a respective intermediate portion integrally connecting the location surface of said flange portion with the receiving portion, each said intermediate portion extending substantially parallel with one another and spaced apart from one another to define a void space therebetween, and an end of the receiving portion extending beyond an edge of each flange portion location surface in the direction of said longitudinal axis.

2. An interconnection device according to claim 1, wherein the flange and receiving portions are each formed from one of cast iron, steel or aluminium.

3. An interconnection device according to claim 1, wherein the receiving portion comprises a tubular shaped formation into which the end portion of an elongate portion may be received.

4. An interconnection device according to claim 3, wherein said receiving portion comprises a bore of substantially circular cross-sectional shape, said bore being provided with axially spaced ribs which extend inwards to provide bearing surface regions for contact by the end portion of an elongate member.

5. An interconnection device according to claim 4, wherein a screw threaded aperture is provided in a wall portion of the receiving portion at an axial position between the or each successive pair of ribs.

6. An interconnection device according to claim 4, wherein an end of said bore comprises an inwardly extending projection to act as a limit stop abutment for abutment by an end of an elongate member when positioned in said bore.

7. An interconnection device according to claim 6, wherein said inwardly extending projection is provided with an aperture.

8. An interconnection device according to claim 1, wherein the locking means comprises at least one screw threaded aperture formed in a wall portion of the receiving portion.

9. An interconnection device according to claim 1, wherein an end of the receiving portion is aligned with an edge of the flange portion.

10. An interconnection device according to claim 1, wherein said locking means of the receiving portion lies in a plane which contains the longitudinal axis of a bore of the receiving portion and which intersects an angle defined between the two location surfaces.

11. A safety rail system for an access hatch having a substantially rigid frame of a substantially rectangular shape and having four corner regions, said safety rail system comprising as discreet and interconnectable components:

elongate post members extending vertically in use, elongate rail members extending substantially horizontally in use, connectors interconnecting the posts and rails, and four structural interconnection devices to which ends of the posts may be secured, said four interconnection devices locating in the vicinity of the four corner regions of the frame, at least two of the interconnection devices as claimed in claim 1 and each arranged, in use, with the end of the receiving portion thereof extending upwards beyond an edge of each flange portion.

12. The structural interconnection device as claimed in claim 1, wherein an angle between each said intermediate portion and each said flange portion is about 45°.

13. A structural interconnection device for attachment of an elongate member to a rigid frame of an access hatch, said interconnection device comprising:

two flange portions each adapted for attachment to the rigid frame; and a receiving portion having locking means for selectively releasably securing thereto an end portion of an elongate member, said receiving portion including a bore of substantially circular cross-sectional shape, said bore having a plurality of axially spaced ribs extending inwardly to each provide a bearing surface region for contact by the end portion of said elongate member, said locking means having a screw threaded aperture in a wall portion of the receiving portion at an axial position between said plural axially spaced ribs, each said two flange portions having a location surface for bearing against said rigid frame, said location surface lying, in use, in a plane which is substantially parallel with a longitudinal axis of the end portion of the elongate member secured to said receiving portion, said plane of the location surface lying, in use, in a plane that is displaced from said longitudinal axis of the end portion of the elongate member and extends substantially perpendicular relative to the location surface of the other of said two flange portions, each of the two flange portions comprising a respective intermediate portion integrally connecting the location surface of said flange portion with the receiving portion, each said respective intermediate portion extending substantially parallel with one another and spaced apart from one another to define a void space therebetween, one end of the receiving portion extending beyond an edge of each flange portion location surface in the direction of said longitudinal axis and an other end of the receiving portion being aligned with an edge of said two flange portions and comprising an inwardly extending projection to act as a limit stop abutment for abutment by an end of an elongate member when said elongate member is in said bore.

14. A structural interconnection device for attachment of an elongate member to a rigid frame of an access hatch, said interconnection device comprising:

a flange portion adapted for attachment to the rigid frame; and a receiving portion having locking means for selectively releasably securing thereto an end portion of an elongate member, said receiving portion including a bore of substantially circular cross-sectional shape, said bore having a plurality of inwardly extending axially spaced ribs that each provide a bearing surface region for contact by an end portion of an elongate member, said locking means having a screw threaded aperture provided in a wall portion of said receiving portion at an axial position between said plural axially spaced ribs, said flange portion having a location surface for bearing against said rigid frame, said location surface lying, in use, in a plane which is substantially parallel with a longitudinal axis of an end portion of an elongate member secured to said receiving portion, said plane of the location surface lying, in use, in a plane which is displaced from said longitudinal axis of the end portion of the elongate member, said flange portion comprising a plurality of intermediate portions integrally connecting the location surface of said flange portion with the receiving portion, a first end of the receiving portion extending beyond an edge of the flange portion location surface in the direction of said longitudinal axis and a second end of the receiving portion being aligned with an edge of the flange portion and having an inwardly extending projection to act as a limit stop abutment for abutment by an end of an elongate member when positioned in said bore.

15. An interconnection device according to claim 14, wherein said locking means lies at a region of the receiving portion furthest from said location surface.

* * * * *